United States Patent [19]

Schiron et al.

[11] 4,142,258

[45] Mar. 6, 1979

[54] SWIMMING POOL WITH WAVE GENERATING INSTALLATION

[76] Inventors: Klaus Schiron, Nelkenstrasse 2, 3100 Celle; Hans F. Rupprath, Am goldenen Acker 35, 3001 Bennigsen, Fed. Rep. of Germany

[21] Appl. No.: 718,163

[22] Filed: Aug. 27, 1976

[30] Foreign Application Priority Data

Aug. 28, 1975 [DE] Fed. Rep. of Germany ..... 2538302

[51] Int. Cl.[2] ..... E04H 3/18; A47K 3/10

[52] U.S. Cl. ..... 4/172.16; 272/26

[58] Field of Search ..... 4/172, 172.15, 172.16, 4/172.11, 172.12, 172.13, 178; 272/1 B, 16, 26

[56] References Cited

U.S. PATENT DOCUMENTS

| | | | |
|---|---|---|---|
| 2,803,835 | 8/1957 | Summers | 4/172.16 X |
| 3,350,724 | 11/1967 | Leigh | 4/178 X |
| 3,523,307 | 8/1970 | Buswell | 4/172 |
| 3,562,823 | 2/1971 | Koster | 4/172.16 |
| 3,598,402 | 8/1971 | Frenzl | 4/172 X |

FOREIGN PATENT DOCUMENTS

| | | | |
|---|---|---|---|
| 140854 | 5/1903 | Fed. Rep. of Germany | 4/172.16 |
| 428394 | 5/1935 | United Kingdom | 4/172.16 |
| 657352 | 9/1951 | United Kingdom | 4/172.16 |
| 699418 | 11/1953 | United Kingdom | 4/172.16 |
| 1190895 | 5/1970 | United Kingdom | 4/172.13 |
| 1194924 | 6/1970 | United Kingdom | 4/172.13 |

*Primary Examiner*—Stuart S. Levy
*Attorney, Agent, or Firm*—Thomas E. Beall, Jr.

[57] ABSTRACT

A swimming pool having an installation for mechanically generating waves comprising a flap which is pivotally mounted in the bottom region of the swimming pool and moved alternatingly.

15 Claims, 2 Drawing Figures

SWIMMING POOL WITH WAVE GENERATING INSTALLATION

BACKGROUND OF THE INVENTION

1. Field of Invention

The invention relates to a swimming pool having an installation for mechanically generating waves.

2. Description of Prior Art

At the present there are two basic principles known for the production of waves in swimming baths.

The first is a pneumatically operated wave generating apparatus in which are provided caissons. These caissons are open at the bottom, subdivided across their width, and cyclically placed under a changing air pressure by means of blowers, so that the water level in the individual caissons is caused to oscillate out-of-phase. These caissons and their blowers are housed adjacent the swimming bath and create the need for a relatively large additional space. Furthermore, due to the structural and physical conditions such pneumatic apparatus has a relatively poor efficiency, as one must particularly bear in mind the cost of an additional pressure resistance.

The other possibility for producing waves is a mechanical apparatus in which waves are generated by means of pistons or small mechanical impellers, i.e. in accordance with the so called vibrating impeller principle. However, such mechanical systems also require a special space around the pool or special wave chambers in the pool. Thus, as in the case of the known pneumatic systems, additional converted space is necessary. Apart from the additional building costs there is no turning surface or wall in those pools intended for sporting events since a grid for the discharge of the waves must be mounted at the front wall of the pool which is normally used as a turning or stopping wall for competitions. Further difficulties arise because a high water level is required in modern pools so as to avoid the so called trough effect. However, when waves are produced, normal water level may be exceeded by 50 cm or more and when the water level is high this may lead to flooding. For this reason the water level must be reduced before using the wave generating apparatus and in fact the additional water must be sucked out in a relatively short space of time into special storage containers which are usually situated underneath the pool. A suction which is dangerous for the bathers may often be produced close to the outlet apertures, particularly when the size of these apertures is relatively small. Finally, the construction of the wave chamber for a mechanical wave generating apparatus is frequently problematic when the chamber must be so dimensioned that its cover plate must be flush with the plane of the remainder of the pool.

3. Object of Invention

The general purpose of the invention is the technical and economic improvement of so called wave baths. More specifically the main objects of the invention are to produce a swimming pool with a wave generating installation or equipment that costs a fraction of the amount required to build the known pools and to provide for a swimming pool which is safer and more economical in operation whilst avoiding the disadvantages of the known systems and taking advantage of the high efficiency achieved by mechanical systems due to the high coupling factor between the mechanical device and the water.

SUMMARY OF THE INVENTION

These objects are achieved in accordance with the invention in that the wave generating unit comprises a flap moved alternatingly and pivotally mounted in the region of the bottom of the swimming pool, i.e., it may thus be integrated with the bottom of the swimming pool or form a part of the surface of the bottom of the swimming pool. This is a completely new approach in that the water displacement necessary for the production of waves comes from the bottom of the pool and no particular constructional measures are necessary in the region of the pool periphery. Instead, the space beneath the pool which was previously unused is now used to accommodate the wave generating equipment.

In an advantageous construction in accordance with the invention the flap is mounted in a recess in an end portion of the pool so as to be pivoted in one direction and moved in the requisite wave generating rhythm by a stroke device positioned in the recess. Thus it is possible for the necessary volume of water to be displaced by moving extremely large surfaces which only need to be moved a relatively short distance. This is in complete contrast to the known types of wave generating apparatus in which, due to the layout of the pool surroundings, only small surfaces are available which must be moved over large distances. In a further construction in accordance with the invention the flap may comprise a number of component flaps each of which is preferably individually movable. The flap or component flaps may be constructed of concrete. The stroke device preferably comprises one or more hydraulic devices such as piston-cylinder devices.

Use of these features, either individually or together, enables the wave generating installation to be integrated in the bottom of the swimming pool without in any way endangering the swimmers, since it is practicable, when applying a suitable control, to use a maximum lift of about 30 cm only. Thus relatively small hydraulic cylinders are required to move the flap or component flaps vertically up and down. A great flexibility in the generation of waves is possible, and frequency and amplitude may be varied at will by controlling the frequency and extent of the movement of the hydraulic cylinders. By use of the component flaps, particularly vigorous waves may be produced, and for this purpose the component flaps or the hydraulic cylinders actuating them should be linked by a common control system. In the known mechanical types of wave generating apparatus these features can not be achieved, or only with considerable additional technical and financial outlay, whilst in the wave producing system constructed in accordance with the present invention merely an additional recess in the region of the wave producing flaps or component flaps is necessary, and the installation and running costs are very low in comparison with those of the converted space which must be provided for apparatus of the known type. Furthermore the additional costs associated with installing the elements of the installation are lower and the financial outlay which must be allowed for when using concrete for the flap or component flaps is very small in relation to the result which is achieved.

A particular advantage of the swimming pool constructed in accordance with the invention lies in the fact that the water level may be lowered without endangering the swimmers. Whilst in the case of traditional wave baths which do not have the capability of lowering the water level, the water level must, when calm, be at least 60 cm below the edge of the pool thus giving rise to the trough effect, modern wave baths operate with a lowered water level such that when the bath is operating normally, i.e., when the wave generating device is not in function, the water level is substantially level with the pool edge, and the usual overflow channels can perform their function. Before the wave operation begins the water level must rapidly, i.e., within about 2 to 3 minutes, be reduced by about 60 cm, and the water removed is conducted into a storage tank. Since the volume of the water removed is considerable, the storage tank is situated adjacent the pool and the cross-section of the outlet apertures is relatively small, the bathers are endangered by the high current velocities. In accordance with a preferred embodiment of the invention these disadvantages may be avoided by providing an additional storage tank with appropriate inlet and outlet installations in the space or recess below the wave generating device or flap which carries an outlet grid lying in the bottom surface. Due to the presence of the outlet grid a large cross sectional area is available for the inlet and outlet of water so that the current velocity is sufficiently low and the bathers are not endangered. At the same time the space below the flap is particularly suitable from the constructional point of view for the positioning of the storage tank since excavating additional earth in the vertical direction is more economically and simply accomplished than extending the breadth or length of the pool complex.

In order to achieve a favorable flow condition and, in particular to avoid vortex formation the water apertures preferably have a streamlined shape comprising concavities, convexities and bevels in the junction area between the pool wall and pool bottom and at the free end of the flap. In other words angular and sharp edges contours should be avoided and uniformly elongated or tapering cross sections should be provided.

In order to ensure that a sufficient cross sectional area of water aperture is available and to minimize the dangerous suction effect as much as possible the flap or component flaps may carry an outlet grid along at least one of their edges. The area of this grid is preferably so dimensioned having regard to the frequency and the size of the flap that a resonance effect occurs, similar to that in an electrical circuit so that a maximum wave height may be achieved with a minimum of energy.

In a further embodiment of the invention the portion of the bottom surface of the pool formed by the wave generating unit, or the flap or component flaps may be vertically raised as a solid body so that, when this part is suitably dimensioned the pool has an intermediate bottom the height of which may be adjusted. The flaps then serve not only for the generation of waves but also as a bottom raising device and this area of the swimming pool can then be made and used as an additional non-swimmers' area. Thus the number of ways in which the invention may be used is increased.

BRIEF DESCRIPTION OF THE DRAWINGS

Other and further objects of the present invention will be apparent from the following description and claims and are illustrated in the accompanying drawings which by way of illustration show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the schematic drawings:

DESCRIPTION OF THE PREFERRED EMBODIMENT

Figure 1:
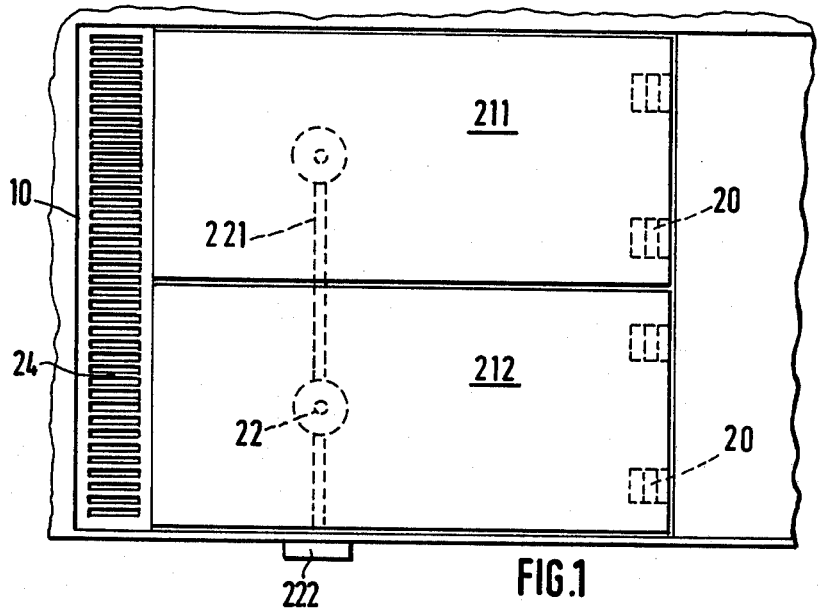
FIG. 1 is a plan view of a portion of a wave swimming pool.
Figure 2:
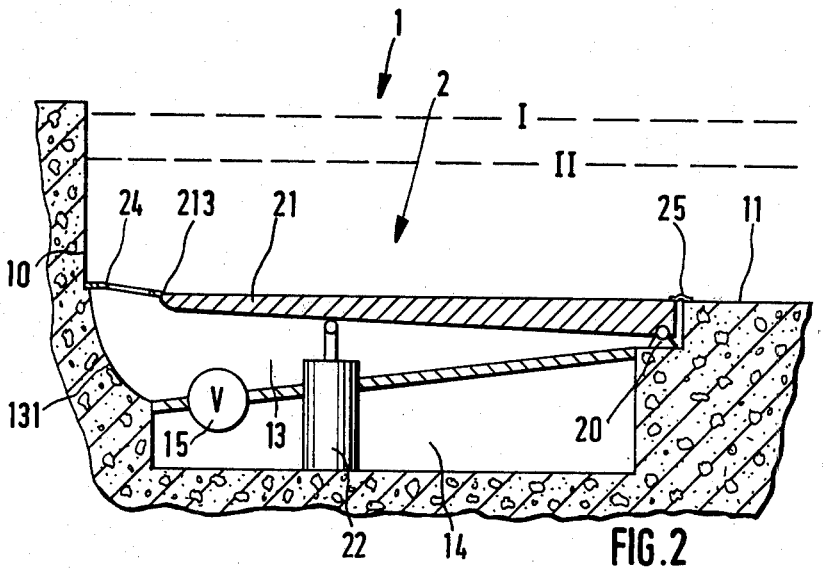
FIG. 2 is a longitudinal section through the portion shown in FIG. 1.

A wave generating unit 2 comprising a flap 21 divided into two component flaps 211, 212 is provided in the end section of a swimming pool 1 whose plan form is rectangular and only part of which is shown. The flap 21 (or its component flaps 211, 212) is mounted in a recess 13 in the swimming pool so as to be pivotable in one direction about a pivot bearing 20. The raising and lowering of the flap 21 resp. the component flaps 211, 212 is effected by means of a stroke device 22 comprising one or several hydraulic cylinder and piston devices situated underneath the flap or each of the component flaps. The hydraulic cylinders are connected by means of common control line 221 to a control device 222 outside the pool.

At the free end of the flap 21 (resp. the component flaps 211, 212) is situated an outlet grid 24 which may be moved up and down with the flap and through which there is communication between the recess 13 and the swimming pool 1 situated above the flap. In the position of rest the flap 21 and the outlet grid 24 lie in the plane of the bottom 11 of the pool. Since there must be a certain gap between the flap 21 and the bottom 11 of the pool in order to ensure freedom of movement of the flap 21 when it is raised by the stroke device 22, a cover 25 is provided so as to avoid injuries or the like. The outlet grid 24 runs closely along the pool wall 10, and if necessary a guard may be provided in the form of an elastic cover.

The recess 13 situated underneath the flap 21 and the outlet grid 24 comprises a space of sufficient size to accomodate the stroke device 22 and to exercise a certain storage and throttling effect when the flap 21 together with the outlet grid 24 are moving, whilst underneath it an additional storage tank 14 is situated which communicates with the recess 13 and thereby with the swimming pool 1 through a valve device 15 so that water may pass from the swimming pool into the storage tank 14 and may be returned. It is the function and purpose of the storage tank to lower the water level in the swimming pool 1, before operating the wave generating unit, from a normal level I, which is nearly up to the level of the edge of the pool, to a wave level II, as rapidly as possible. The difference between levels I and II corresponds approximately to about half the amplitude of the waves.

In order to achieve favourable current patterns and conditions and to avoid the formation of vortices the edge 213 of the flap 21 has a rounded contour, whilst the junction of the pool wall 10 with the recess 13 or the pool bottom 11 has a concave curvature 131.

Assuming the flap 21 has a length of about 9 meters, height of lift of the flap at its edges 213 is about 30 cm in order to achieve the normal wave amplitude of about 1 m. By appropriate control of the hydraulic cylinders 22 by means of the control apparatus 222 the wave pattern can always be varied by altering the lift and frequency of movement of the flap 21 or of the component flaps 211, 212 and it is also possible that the patte of movement may follow a predetermined program. When the measurements are as given above the depth of the recess 13 below the flap 21 need not be substantially more than 50 cm.

It should be noted that any of the aforegoing descriptions concerning the construction and/or function of the flap 21 may be related to the embodiment in accordance with the invention which provides for two or several component flaps 211, 212. For sake of simplicity only no explicit mention has been made to this embodiment in each specific case.

What is claimed is:

1. A swimming pool having generally vertical side walls and a generally horizontal bottom, in combination with an installation for mechanically generating waves, comprising:

a flap pivotally mounted about a generally horizontal axis within the region of the bottom of the swimming pool;

power means for cyclically pivoting said flap about its axis to generate waves;

said flap forming a portion of said bottom and in one of its pivoted positions being coextensive with the remainder of said bottom;

a recess beneath and covered by said flap, and containing therein said power means;

said recess including a side wall opposite and generally parallel to said axis that extends arcuately from its top generally in alignment with the adjacent side wall of the swimming pool inwardly with respect to the recess to the bottom wall of said recess, and said flap having an outer edge opposite from said axis with a similar arcuate surface spaced from said first-mentioned arcuately extending recess side wall and to provide therebetween a contoured passage for water to enter and exit from said recess as said flap is pivoted about its axis by said power means.

2. The swimming pool of claim 1, further including a grid mounted between said flap and swimming pool side walls to span the space between said flap outer edge and the top of said arcuately extending recess side wall.

3. The swimming pool according to claim 1, wherein said grid is rigidly secured to and along the entire outer edge of said flap along one side and along its opposite side moves closely adjacent to the adjacent swimming pool side wall during pivoting of said flap by said power means.

4. The swimming pool according to claim 2, further including a storage tank beneath said recess, and flow control means for moving water from said swimming pool through said recess and into said storage tank to lower the water level within the pool prior to the generation of waves by said power means pivoting said flap and for controlling the flow of water out of said storage tank through said recess and into said swimming pool to raise the water level within the pool after the termination of wave generation by said power means pivoting said flap.

5. A swimming pool having generally vertical side walls and a generally horizontal bottom, in combination with an installation for mechanically generating waves, comprising:

a flap pivotally mounted along a generally horizontal axis within the region of the bottom of the swimming pool;

power means for cyclically pivoting said flap about its axis to generate waves;

said flap forming a portion of said bottom and in one of its pivoted positions being coextensive with the remainder of said bottom;

a recess beneath and covered by said flap, and containing therein said power means;

a water storage tank entirely beneath said flap, and fluid flow control means for moving water from said swimming pool past said flap and into said storage tank to lower the water level of said swimming pool prior to said power means pivoting said flap to generate waves, and thereafter moving water from said storage tank past said flap and into said swimming pool for returning the water level to its normal height after the generation of waves by said power means pivoting said flap.

6. A swimming pool having generally vertical side walls and a generally horizontal bottom, in combination with an installation for mechanically generating waves, comprising:

a flap having opposed sides and opposed ends, said flap being pivotally mounted about a generally horizontal axis along one end, said flap forming a part of the bottom of the swimming pool, and said flap extending substantially entirely between two opposed generally vertical side walls of the swimming pool with said flap opposed side walls being closely adjacent said swimming pool opposed generally vertically side walls; power means for cyclically pivoting said flap up and down about its axis to generate waves; means between the end of said flap opposite from said axis and the adjacent generally vertical one end wall of the swimming pool, forming a flow passage in said bottom providing free water flow from above to below and from below to above said flap along substantially the entire one end of said swimming pool to generate waves at said one end of said swimming pool as said power means oscillates said flap about its axis; and automatic control means operating said power means to continuously cycle and regulate said power means for continuous up and down pivoting of said flap to correspondingly produce a continuous series of waves emanating from said one side wall.

7. The swimming pool according to claim 6, wherein said flap comprises two separate coplanar flap components pivotable about a common axis, and said power means pivots said flap components in unison about said axis.

8. The swimming pool according to claim 6, wherein there are four of said walls defining a rectangular swimming pool.

9. The swimming pool according to claim 6, wherein said flap is constructed of concrete.

10. The swimming pool according to claim 6, wherein said flap in one of its pivoted positions is coextensive with the remainder of said bottom.

11. The swimming pool according to claim 10, wherein said flap extends substantially entirely between two opposed side walls.

12. The swimming pool according to claim 10, further including a recess beneath and covered by said flap, and containing therein said power means.

13. The swimming pool according to claim 12, wherein said power means is a fluid expansible chamber device having a piston and cylinder connected between the bottom of said recess and said flap at a distance spaced from said axis.

14. The swimming pool according to claim 13, wherein said flap is constructed of concrete.

15. The swimming pool according to claim 6, wherein said automatic control means changes the amplitude and frequency of the flap pivoting according to a fixed program.

* * * * *